US009706899B2

(12) United States Patent
Lee

(10) Patent No.: US 9,706,899 B2
(45) Date of Patent: Jul. 18, 2017

(54) DOUBLE DOORMAT

(71) Applicant: Global The One Korea Co., Ltd., Gyeonggi-do (KR)

(72) Inventor: Sang Yeon Lee, Gyeonggi-do (KR)

(73) Assignee: GLOBAL THE ONE KOREA CO., LTD., Gyeonggi-Do (KR)

( * ) Notice: Subject to any disclaimer, the term of this patent is extended or adjusted under 35 U.S.C. 154(b) by 316 days.

(21) Appl. No.: 14/615,303

(22) Filed: Feb. 5, 2015

(65) Prior Publication Data

US 2016/0183764 A1 Jun. 30, 2016

(30) Foreign Application Priority Data

Dec. 29, 2014 (KR) ..... 10-2014-0192117

(51) Int. Cl.

| | |
|---|---|
| ***A47L 23/22*** | (2006.01) |
| ***A47L 23/26*** | (2006.01) |
| ***A47G 27/02*** | (2006.01) |

(52) U.S. Cl.

CPC ..... *A47L 23/22* (2013.01); *A47G 27/02* (2013.01); *A47L 23/266* (2013.01); *Y10T 428/24025* (2015.01); *Y10T 428/24322* (2015.01); *Y10T 428/24331* (2015.01); *Y10T 428/24612* (2015.01)

(58) Field of Classification Search

CPC ..... A47L 23/22; A47L 23/24; A47L 23/26; A47L 23/266; A47G 27/02; B60N 3/04; B60N 3/042; B60N 3/044; B60N 3/046; B60N 3/048; Y10T 428/24–428/24025; Y10T 428/24273–428/24347; Y10T 428/24612

USPC ..... 15/215–217, 221, 238–241; 52/177–181; 296/97.23; 428/98–101, 131–140, 172

See application file for complete search history.

(56) References Cited

U.S. PATENT DOCUMENTS

| | | | | | |
|---|---|---|---|---|---|
| 2,810,671 | A * | 10/1957 | Taylor | B60N 3/044 | 428/101 |
| 3,087,752 | A * | 4/1963 | Winchester | B60K 26/02 | 15/215 |
| 3,605,166 | A * | 9/1971 | Chen | A47L 23/24 | 15/215 |
| 2006/0154018 | A1* | 7/2006 | Tsai | A47L 23/266 | 428/99 |

FOREIGN PATENT DOCUMENTS

| | | | |
|---|---|---|---|
| GB | 2407765 | * | 5/2005 |
| JP | 7-51216 | * | 2/1995 |
| JP | 8-150111 | * | 6/1996 |

* cited by examiner

*Primary Examiner* — Mark Spisich

(74) *Attorney, Agent, or Firm* — The PL Law Group, PLLC

(57) ABSTRACT

Provided is a double doormat including an upper mat and a lower mat, and in detail, to a double doormat in which foreign substances, such as dirt on shoes, are accommodated in a space between an upper mat and a lower mat such that an area around an entrance is clean, a cleaning cycle is extended by making the space where the foreign substances are accommodated big, and the accommodated foreign substances are prevented from contaminating an area around the double doormat by escaping upward from the upper mat due to an impact of dusting the shoes.

2 Claims, 5 Drawing Sheets

Prior Art

DOUBLE DOORMAT

RELATED APPLICATION

This application claims the benefit of Korean Patent Application No. 10-2014-0192117, filed on Dec. 29, 2014, in the Korean Intellectual Property Office, the disclosure of which is incorporated herein in its entirety by reference.

BACKGROUND

1. Field

One or more exemplary embodiments relate to a double doormat including an upper mat and a lower mat, and more particularly, to a double doormat in which foreign substances, such as dirt on shoes, are accommodated in a space between an upper mat and a lower mat such that an area around an entrance is clean, a cleaning cycle is extended by making the space where the foreign substances are accommodated big, and the accommodated foreign substances are prevented from contaminating an area around the double doormat by escaping upward from the upper mat due to an impact of dusting the shoes.

2. Description of the Related Art

Generally, a doormat placed in front of a front door is used by a person to dust foreign substances, such as sand or dust, from bottoms of shoes to prevent the foreign substances from entering a house.

A conventional example of a doormat 100 is disclosed in KR 10-1461443 and is shown in FIGS. 1 through 3.

The doormat 100 is manufactured by cutting and planting nylon fibers in lengths of 1 to 5 mm, and includes a base 160 forming a bottom surface, a base fabric 150 disposed on the base 160, an adhesive 140 disposed on a top surface of the base fabric 150, flocking piles 110 that are planted to the base fabric 150 by using the adhesive 140, and an edge portion 130 formed of an aluminum molding material and around side and lower edges of the base 160.

Since the doormat 100 having such a structure includes the planted flocking piles 110, an area stepped by a person is immediately restored to the original state, and foreign substrates 170 attached to a bottom of a shoe may be easily removed.

However, as shown in FIG. 3, the foreign substrates 170 removed from the shoe are trapped between the flocking files 110 or exposed over surfaces of the flocking piles 110 and thus not only an external appearance of the doormat 100 is not good but also the doormat 100 needs to be frequently cleaned. In addition, dust may rise when people step on the doormat 100.

Also, it is cumbersome to clean the foreign substrates 170 trapped between the flocking piles 110 of the doormat 100.

SUMMARY

One or more exemplary embodiments include a double doormat in which foreign substrates, such as dirt, removed from shoes are conveniently cleaned.

One or more exemplary embodiments include a double doormat in which a cleaning cycle is extended by making a space where foreign substrates removed from shoes are accommodated big.

One or more exemplary embodiments include a double doormat in which foreign substrates removed from shoes are prevented from escaping from the doormat.

Additional aspects will be set forth in part in the description which follows and, in part, will be apparent from the description, or may be learned by practice of the presented embodiments.

According to one or more exemplary embodiments, a double doormat includes: an upper mat including a plurality of holes into which foreign substances enter; a lower mat having a size corresponding to the upper mat and including a plurality of concave grooves in which the foreign substrates that entered into the plurality of holes are accommodated; a first magic tape sewed at an edge of the upper mat; and a second magic tape sewed at an edge of the lower mat and mutually detachably attached to the first magic tape.

The plurality of holes may be wide at a top surface of the upper mat and may be narrow at a bottom surface of the upper mat.

Each of the plurality of holes may include a first hole formed on a top surface of the upper mat and a second hole formed on a bottom surface of the upper mat, wherein the first and second holes may be mutually connected to each other, and the first and second holes may be narrowed towards a center in the upper mat respectively from the top surface of the upper mat and the bottom surface of the upper mat, forming a small diameter portion at a boundary portion between the first and second holes.

Each of the second holes and each of the plurality of concave grooves may be disposed mutually corresponding to each other.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
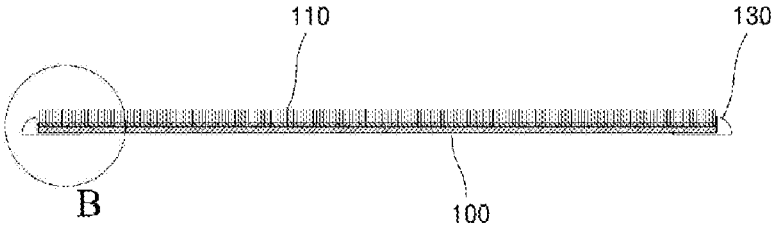
FIGS. 1 through 3 are schematic diagrams for describing a conventional doormat.
Figure 2:
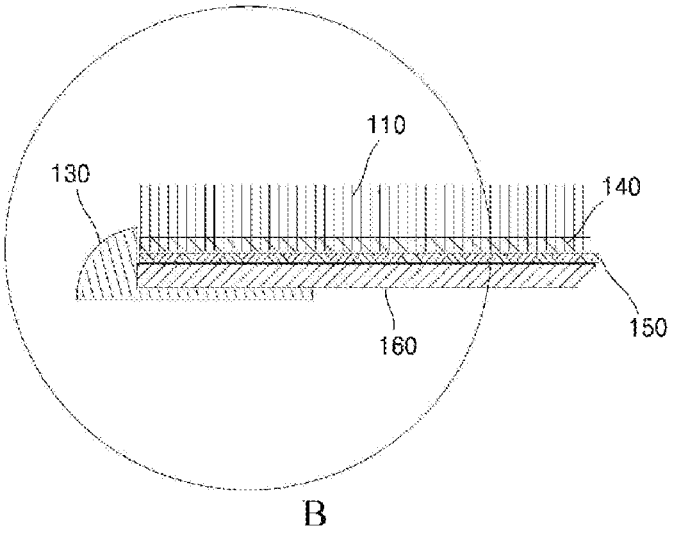
Prior Art Fig. 2
Figure 3:
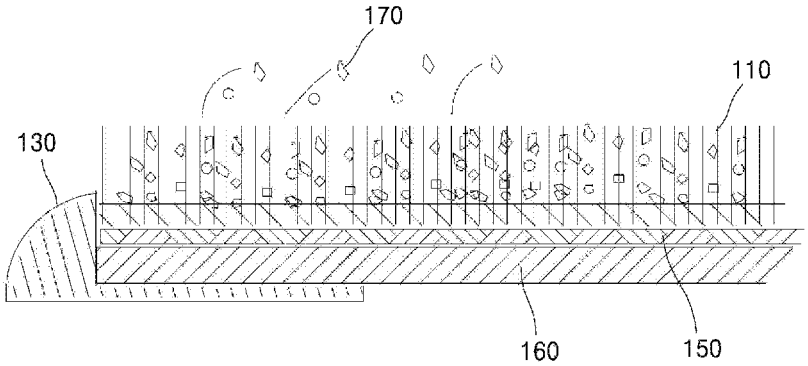

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the exemplary embodiments are merely described below, by referring to the figures, to explain aspects of the present description.

A doormat according to one or more exemplary embodiment is a double doormat including an upper mat and a lower mat, in which foreign substances, such as dirt on shoes, are accommodated in a space between the upper mat and the lower mat such that an area around an entrance is clean, a cleaning cycle is extended by making the space where the foreign substances are accommodated big, and the accommodated foreign substances are prevented from contaminating an area around the double doormat by escaping upward from the upper mat due to an impact of dusting the shoes.

Figure 4:
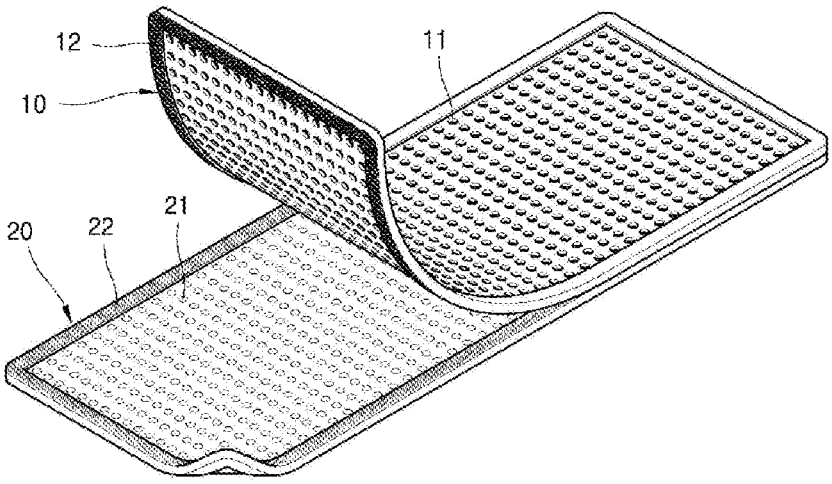
Prior Art Fig. 4
FIG. 4 is a perspective view of a doormat according to an exemplary embodiment.
Figure 5:
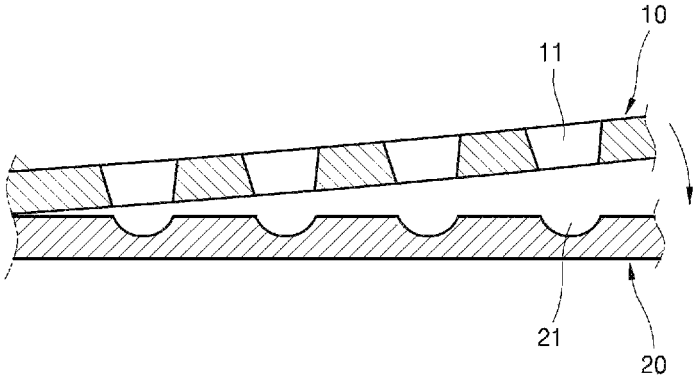
FIG. 5 is a cross-sectional view of the doormat of FIG. 4.

Referring to FIGS. 4 and 5, a doormat according to an exemplary embodiment includes an upper mat 10 including a plurality of holes 11 into which foreign substances, such as dirt, enter, a lower mat 20 having a size corresponding to the upper mat 10 and including a plurality of concave grooves 21 in which the foreign substrates that entered into the plurality of holes 11 are accommodated, a first magic tape 12 sewed at an edge of the upper mat 10, and a second magic tape 22 sewed at an edge of the lower mat 20 and mutually detachably attached to the first magic tape 12.

The plurality of holes 11 are wide at a top surface of the upper mat 10 and are narrow at a bottom surface of the lower mat 10 such that the foreign substrates smoothly enter the holes 11.

Also, the holes 11 and the concave grooves 21 are disposed mutually corresponding to each other such that the space where the foreign substrates are accommodated is big.

Figure 6:
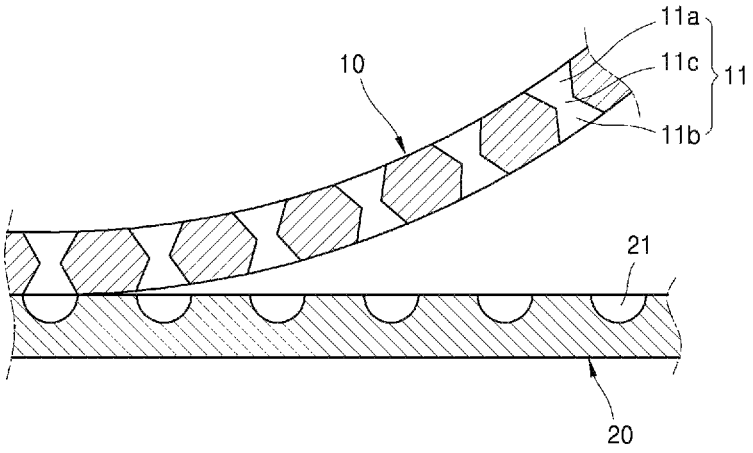
FIG. 6 is a cross-sectional view of a doormat according to another exemplary embodiment.
Figure 9:
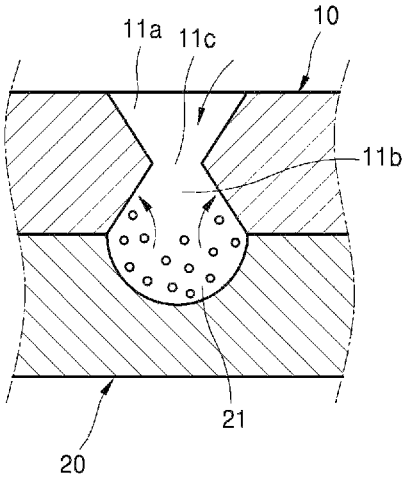
FIG. 9 is an enlarged diagram for describing an operation of the doormat of FIG. 6.

Referring a doormat according to another exemplary embodiment shown in FIGS. 6 and 9, each of the plurality of holes 11 includes a first hole 11*a* formed in the top surface of the upper mat 10 and a second hole 11*b* formed in the bottom surface of the upper mat 10.

The first and second holes 11*a* and 11*b* are mutually connected to each other, in which the first and second holes 11*a* and 11*b* are narrowed toward a center in the upper mat 10 respectively from the top surface and the bottom surface of the upper mat 10, such that a small diameter portion 11*c* is formed at a boundary portion between the first and second holes 11*a* and 11*b*.

The second holes 11*b* and the concave grooves 21 are disposed mutually corresponding to each other.

Referring to FIG. 9, foreign substrates, such as dirt, smoothly enter into the concave groove 21 through the first hole 11*a* having a wide entry.

Also, since the space where the foreign substrates are accommodated is made big by the second hole 11*b* and the concave groove 21, a cleaning cycle may be extended, and the foreign substrates accommodated in the concave groove 21 and the second hole 11*b* are prevented from escaping the doormat by the small diameter portion 11*c*.

For example, the foreign substrates accommodated in the concave groove 21 may jump out from the concave groove 21 due to an impact of a user dusting shoes by stamping his/her feet, but according to an exemplary embodiment, the foreign substrates are prevented from escaping the concave groove 21 by forming the small diameter portion 11*c*.

Figure 7:
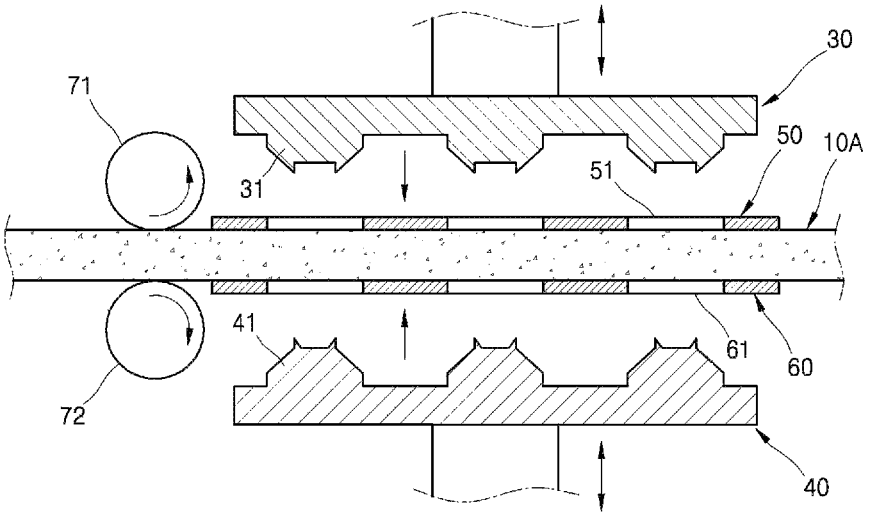
FIGS. 7 and 8 are schematic diagrams for describing a method of manufacturing an upper mat of FIG. 6.
Figure 8:
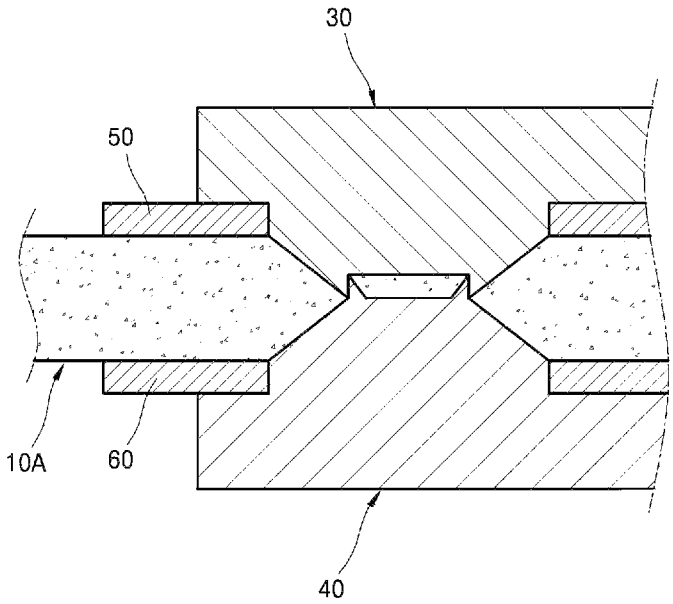

A method of manufacturing the upper mat 10 of FIG. 6 will now be described with reference to FIGS. 7 and 8.

The upper mat 10 is foam-formed by adding a foaming agent to ethylene-vinyl acetate (EVA) and then applying heat and pressure to the EVA to obtain a result product. Then, the result product passes between a pair of rollers 71 and 72 to be discharged in the form of a sheet 10A, and the sheet 10A is guided by upper and lower guide plates 50 and 60 respectively having guide holes 51 and 61. Then, the first and second holes 11*a* and 11*b* are formed in the sheet 10A by pressing the sheet 10A with an upper mold 30 and a lower mold 40.

Upper and lower press portions 31 and 41 having shapes corresponding to the first and second holes 11*a* and 11*b* are formed respectively at the upper and lower molds 30 and 40, and blades may be formed at ends of the upper and lower press portions 31 and 41 so as to punch through a part of the sheet 10A corresponding to the small diameter portion 11*c*.

According to the doormat described above, foreign substances, such as dirt on shoes, are accommodated in a space between the upper mat 10 and the lower mat 20 such that an area around an entrance is maintained clean, and when the doormat is to be cleaned, the first and second magic tapes 12 and 22 are detached from each other to separate the upper and lower mats 10 and 20, and the foreign substrates are shaken off, thereby conveniently cleaning the doormat.

Also, as the space where the foreign substrates are accommodated is formed by the second hole 11*b* and the concave groove 21, the space may be made big, thereby extending the cleaning cycle.

Also, as the small diameter portion 11*c* is formed, the accommodated foreign substrates may be prevented from contaminating the area around the doormat by escaping upward from the upper mat 10 due to an impact of dusting shoes.

While one or more exemplary embodiments have been described with reference to the figures, it will be understood by those of ordinary skill in the art that various changes in form and details may be made therein without departing from the spirit and scope of the inventive concept as defined by the following claims.

What is claimed is:

1. A double doormat comprising:

an upper mat comprising a plurality of holes into which foreign substances enter, each of the plurality of holes comprising a first hole formed on a top surface of the upper mat and a second hole formed on a bottom surface of the upper mat, wherein the first and second holes are mutually connected to each other, and the first and second holes are narrowed towards a center in the upper mat respectively from the top surface of the upper mat and the bottom surface of the upper mat, forming a small diameter portion at a boundary portion between the first and second holes, a lower mat having a size corresponding to the upper mat and comprising a plurality of concave grooves in which the foreign substances that entered into the plurality of holes are accommodated;

a first tape sewed at an edge of the upper mat; and a second tape sewed at an edge of the lower mat and mutually detachably attached to the first tape.

2. The double doormat of claim 1, wherein the plurality of holes and the plurality of concave grooves are disposed mutually corresponding to each other.

* * * * *